US008047218B1

(12) United States Patent
Shin

(10) Patent No.: US 8,047,218 B1
(45) Date of Patent: Nov. 1, 2011

(54) CABIN TENT FRAME

(76) Inventor: Jeaki Shin, Gyeonggi-do (KR)

( * ) Notice: Subject to any disclaimer, the term of this patent is extended or adjusted under 35 U.S.C. 154(b) by 0 days.

(21) Appl. No.: 13/072,771

(22) Filed: Mar. 27, 2011

(30) Foreign Application Priority Data

Feb. 8, 2011 (KR) ..... 10-2011-00111893

(51) Int. Cl.
*E04H 15/48* (2006.01)
*E04H 15/28* (2006.01)

(52) U.S. Cl. ..... 135/135; 135/147; 135/98

(58) Field of Classification Search ..... 135/98, 135/124, 135, 147, 151, 158, 28–29, 31–32
See application file for complete search history.

(56) References Cited

U.S. PATENT DOCUMENTS

| | | | | |
|---|---|---|---|---|
| 5,230,358 | A * | 7/1993 | Forell | 135/98 |
| 5,293,890 | A * | 3/1994 | Park et al. | 135/98 |
| 5,797,695 | A * | 8/1998 | Prusmack | 403/170 |
| 6,581,617 | B2 * | 6/2003 | Ham et al. | 135/135 |
| 7,607,447 | B1 * | 10/2009 | Han | 135/135 |
| 7,861,736 | B2 * | 1/2011 | Choi | 135/143 |
| 2007/0051398 | A1 * | 3/2007 | Kim | 135/135 |
| 2007/0051399 | A1 * | 3/2007 | Jung | 135/135 |
| 2007/0151588 | A1 * | 7/2007 | Yul et al. | 135/91 |

FOREIGN PATENT DOCUMENTS

KR 10-2008-0090204 A 10/2008

* cited by examiner

*Primary Examiner* — Winnie Yip
(74) *Attorney, Agent, or Firm* — Portland IP Law LLC

(57) ABSTRACT

Disclosed is a cabin tent frame. The cabin tent frame includes a housing 20 having an insertion portion 23, an inserting slot 22 and an engaging slot 22*b*, a slider 10 slidably coupled with the lower portion of the housing 20, a fixing unit 30 elastically supported in the slider 10, an upper connecting pole 50 having an engaging piece 52 and a connecting bar 51, a cover 40 coupled to the upper portion of the housing 20, and a connector 53, one end of which is hingedly connected to the upper connecting pole 50 and the other end of which is hingedly connected to the slider 10. Therefore, with some embodiments the present invention, the rotational bearing capacity for the engaging piece 52 can be improved when the upper connecting pole 50 rotates, and at the same time damage to the engaging piece 52 can be substantially reduced.

1 Claim, 4 Drawing Sheets

CABIN TENT FRAME

CROSS-REFERENCE TO RELATED APPLICATIONS

The present disclosure claims priority from Korean Patent Application No. 10-2011-0011189, filed on Feb. 8, 2011 in the Korean Intellectual Property Office, the entire disclosure of which is incorporated herein by reference.

BACKGROUND

1. Technical Field

The present invention relates to a cabin tent frame, and more specifically to a cabin tent frame which makes it easy to install and uninstall the tent by firmly supporting the upper frame of the cabin tent and making folding and unfolding work easy.

2. Description of the Related Art

Recently due to the spread of leisure culture, various kinds of tents are used. Among them, so-called cabin tents with a relatively high ceiling in consideration of the movements of the human body when doing things in the tent are widely supplied. Such cabin tents are propagated extensively despite the large volume and weight of the tent thanks to a convenient transportation means such as cars.

Some of such cabin tents are made in an automatically folding type to enhance user convenience. Such a tent has an advantage in that it can be installed and uninstalled quickly just by unfolding and folding of the tent after putting it on the place where it is to be installed.

Such an automatic folding type cabin tent is disclosed in the Korean Patent Registration No. 10-874593.

The above automatic folding type cabin tent includes a plurality of upper poles, upper and lower housings, a plurality of folding supports, and a lower pole. The paired upper poles are installed on a front surface and a rear surface of the automatic folding cabin tent. Each of the upper poles is pivotally installed at upper end of the automatic folding cabin tent. The upper poles form a roof of the automatic folding cabin tent. The upper and lower housings are coupled to the outer circumference of upper and lower portions of the upper poles, respectively. One of the upper and lower housings is fixed to the upper pole, and remaining one of the upper and lower housings is installed to slidably move along the upper pole. The paired folding supports are installed between adjacent upper poles at a rear surface or side surfaces of the automatic folding cabin tent so as to cross each other in an "X" shape. Both end portions of the folding supports are pivotally connected to the upper and lower housings of the adjacent upper poles. The lower poles are extended from a lower end of the each upper poles to form the side surfaces of the automatic folding cabin tent.

However, in such a conventional cabin tent frame, a plurality of upper poles and folding supports are complicatedly linked with each other, so repeated folding and unfolding processes are necessary for folding and unfolding the cabin tent. Because of that, it has a problem in that it is difficult to use for beginners or unskilled users.

To solve such a problem, an automatic umbrella type cabin tent is proposed. To the top of the main frame that makes the tent frame are hinge-engaged upper connecting poles or connecting members and the upper connecting poles are pivotally installed to make it possible to fold and unfold the upper connecting poles.

To uninstall by folding the conventional automatic cabin tent formed as mentioned above, the user holds and moves inwardly by force the diagonally located upper connecting pole among the upper connecting poles that are pivotally connected to the connecting member, then the lower portions of all upper connecting poles are moved downward to make the tent fold.

And to install on the ground by unfolding the tent that was dismantled like this, the user unfolds by moving downward by force the lower portion of the lower connecting pole that is to be folded adjacent to the upper connecting pole. After that, the user holds and moves upward by force the lower portion of the diagonally located upper connecting pole, then all upper connecting poles are automatically unfolded by the elastic restoring force of an elastic spring at a certain point of time to complete the installation of the tent.

However, in such a conventional cabin tent, an engaging slot is formed in the upper connecting pole, and an engaging protrusion that is inserted into the engaging slot is formed in the connecting member, which is hinge-engaged to the upper connecting pole. But due to the engaging slot formed in the upper connecting pole, the size of the upper connecting pole is reduced so that the supporting force of the upper connecting pole is decreased. This makes a problem that the upper connecting pole may be damaged even by a little force of the user when folding and unfolding the cabin tent.

Another problem is that contact occurs in many portions between the upper connecting pole, main frame and connecting members when folding the cabin tent, and the user's hand may frequently get jammed in the contact portions, so the risk of safety accidents increases.

SUMMARY

Therefore, in order to overcome the foregoing problems of the conventional art, the present disclosure provides a cabin tent frame whereby the rotational bearing capacity for the engaging piece is improved when rotating the upper connecting pole as well as the damage to the connecting piece is prevented and the rotation of the upper connecting pole is restricted to a predetermined range as well as safety accidents are prevented.

In one embodiment, there is provided a cabin tent frame comprising: a housing having an insertion portion with a through hole formed in the longitudinal direction of the housing, a plurality of inserting slots formed at equal intervals on an outer circumference of an upper elongated portion which is outwardly elongated from the insertion portion of the housing, and engaging slots formed on both side walls of the inserting slot; a slider slidably coupled with the housing in such a manner that the insertion portion of the housing is inserted inside the slider; a fixing unit which is inserted into the through hole of the housing to be fixed and installed in the slider, and elastically supported through at least one elastic member installed in the through hole of the housing; an upper connecting pole having an engaging piece in which engaging protrusions are formed in protrusion on both sides of the upper end so as to be inserted into the engaging slot of the housing for hinge-engaging therewith, and a connecting bar to which the engaging piece is installed at an upper end thereof; a cover which covers the upper portion of the engaging slot to prevent the breakaway of the engaging piece and is coupled to the upper portion of the housing; and a connector one end of which is hinge-engaged to the upper connecting pole and the other end of which is hinge-engaged to the slider, wherein the connecting bar of the upper connecting pole is inserted into an inserting hole formed in the engaging piece, and one end of the connecting bar is inserted into the inserting hole as far as the position of the engaging protrusion formed at the engaging piece.

Preferably, the engaging piece further includes a contact protrusion formed at the inward lower portion thereof, so that the engaging piece comes into contact with the connector during the folding of the upper connecting pole so as to restrict the rotation of the upper connecting pole.

According to some embodiments of the present invention, an engaging slot may be formed in the housing, and the upper connecting pole may be provided with an engaging piece in which an engaging protrusion hingedly coupled to the engaging slot is formed, and a connecting bar is inserted into the engaging piece, so that the rotational bearing capacity for the engaging piece is improved during the rotation of the upper connecting pole and at the same time damage to the engaging piece can be substantially reduced.

In addition, by forming in the engaging piece a contact protrusion that comes into contact with the connector during the folding of the upper connecting pole, the rotation of the upper connecting pole is restricted to a predetermined range and at the same time hand-jamming may be substantially reduced during the folding of the upper connecting pole, so that an effect of preventing safety accidents is provided.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Hereinafter, the present disclosure will be described in more detail, in conjunction with the accompanying drawing.

Figure 1:
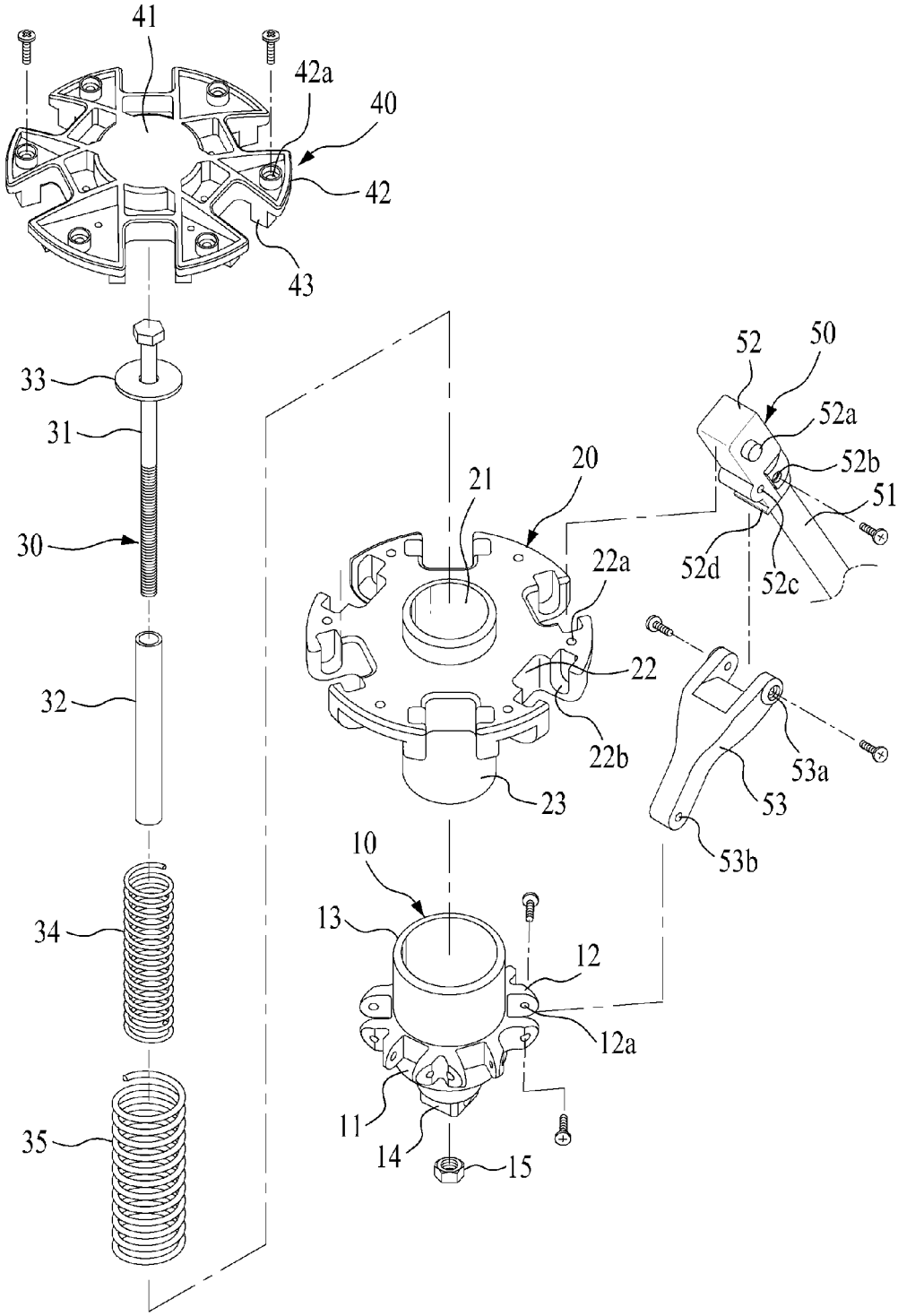
FIG. 1 is an exploded perspective view showing a cabin tent frame according to an embodiment of the present invention.

As shown in FIG. 1, the cabin tent frame according to an embodiment may include a slider 10, a housing 20, a fixing unit 30, a cover 40, an upper connecting pole 50, and a connector 53.

The cylindrical shape slider 10 may be slidably coupled with the housing 20 in such a manner that an insertion portion 23 of the housing 20 can be inserted inside the slider 10. The slider 10 includes a lower casing portion 11, a plurality of engaging projections 12, an upper casing portion 13, a connecting portion 14 and a fastening means 15.

The lower casing portion 11 forms the lower configuration of the slider 10. The plurality of engaging slots 12 are formed around the upper outer circumference of the slider 10, and on both side walls of at least one of the engaging slots 12 are formed hinge holes 12*a*.

The upper casing portion 13 is a cylindrical shape member formed at the upper side of the lower casing portion 11 with the inner circumference widened so as to be larger than the inner circumference of the lower casing portion 11, and into the upper casing portion 13 is inserted the lower portion of the housing 20. The connecting portion 14 is formed under the lower casing portion 11 in a ring shape and a tent cloth is coupled and fixed to it.

The fastening means 15, which is inserted into the inserting hole formed in the connecting portion 14, may be screwed with the thread portion of the fixing unit 30 so as to fasten and fix the fixing unit 30 inside of the slider 10. It is preferable that such a fastening means 15 includes a fastening and fixing member such as a nut.

The housing 20 may be slidably inserted in an inside of the slider 10 and includes a through hole 21, a plurality of inserting slots 22, a plurality of engaging slots 22*b* and the insertion portion 23.

The through hole 21 is an inner hole formed in the longitudinal direction of the housing 20, and the inner diameter of the lower portion is formed smaller than that of the upper portion so that a stepped portion is formed at the bottom of the insertion portion 23.

The plurality of inserting slots 22 may be formed at substantially equal intervals on an outer circumference of an upper elongated portion which is outwardly elongated from the insertion portion 23 of the housing 20, and on either side of the inserting slot 22 is formed an engaging slot 22*b* cut from up to down. On the top side between the inserting slots 22 are formed fixing holes 22*a* respectively.

The insertion portion 23 has the through hole 21 formed inside in the longitudinal direction to be built in a cylindrical shape, and forms the insertion portion of the housing 20 under the inserting slot 22.

The fixing unit 30, which is inserted from up to down into the through hole 21 of the housing 20, is fixed and engaged to the inside of the slider 10 by the fastening means 15. The fixing unit 30 elastically supports the slider 10 through elastic members installed in the through hole 21 of the housing 20 so that the slider 10 is capable of sliding against the housing 20. The fixing unit 30 includes a fastening member 31, a guide tube 32, a fixing member 33, and the elastic members 34 and 35.

The fastening member 31 is of a long bolt shape and has the thread portion formed at the lower portion to make it possible to be fastened and fixed with the fastening means 15. The guide tube 32 is inserted into the outside of the fastening member 31 to guide the lengthwise movement of the fastening member 31.

The fixing member 33 is formed in a hollow disc shape and has a fixing hole corresponding to the center of the fastening member 31 to be inserted and pass through.

The elastic member is an elastic means inserted into the outer circumference of the guide tube 32 to elastically support the slider 10 upward. With the elastic member inserted into the through hole 21, one end of it is in contact with the circumference of the lower side of the fixing member 33 and the other end is in contact with the stepped portion formed at the bottom of the insertion portion 23.

A coil spring may be used as the elastic member so as to provide elastic force in the longitudinal direction. It is especially preferable to use a plurality of coil springs with the outer diameters different and the spirals inverse each other.

Such an elastic member may include a first spring 34 and a second spring 35 in which the diameter is larger than that of the first spring 34, so that the first spring 34 maybe inserted into the second spring 35, and the spiral is formed inversely to that of the first spring 34.

Accordingly, the fastening member 31 is inserted in the through hole 21 through the first and second springs 34 and 35, and the thread portion formed on the fastening member 31 is screwed and fixed to the fastening means 15 installed in the connecting portion 14 of the slider 10, so that the fastening unit 30 is elastically fastened and fixed to the slider 10.

A plurality of upper connecting poles 50, which are hinge-engaged or hingedly coupled in a radial form to the inserting slots 22 of the housing 20, are poles composing the upper portion of the cabin tent and each include the connecting bar 51 and an engaging piece 52.

The connecting bar 51 formed in a load shape, which is a pole composed so as to support the upper portion of cabin tent, fixes and supports the upper portion of cabin tent cloth. It is possible to form the sectional shape of the connecting bar 51 in various shapes such as a half moon or an ellipse. According to one embodiment, the connecting bar 51 may be formed in a half moon shape to prevent the connecting bar 51 from being rotated in a radial direction thereof.

In addition, to the end of the connecting bar 51 are engaged side connecting poles or various supporting connecting poles to compose a plurality of connecting poles of a cabin tent. The upper end of the connecting bar 51 is inserted into the inserting hole formed in the engaging piece 52 so that the engaging piece 52 is fixed and installed at the upper end of the connecting bar 51.

The engaging piece 52 inserted to the upper end of the connecting bar 51 has engaging protrusions 52*a* formed in protrusion on both sides of the upper portion thereof. At the middle portion of the engaging piece 52 are formed a fastening hole 52*b* and hinge hole 52*c*, and at the lower portion of the engaging piece 52 is formed a contact protrusion 52*d*.

The engaging protrusions 52*a* formed in protrusion on both sides of the upper end of the engaging piece 52 are inserted into the engaging slots 22*b* of the housing 20 for hinge-engaging therewith. Accordingly, by inserting and fitting the engaging protrusions 52*a* of the engaging piece 52 into the engaging slots 22*b*, the upper connecting pole 50 is pivotally engaged with the housing 20.

The fastening hole 52*b* formed in the middle portion of the engaging piece 52 is a hole for fixing and engaging the connecting bar 51 and the engaging piece 52. The connecting bar 51 and the engaging piece 52 are engaged and fixed by using a fastening and fixing means such as a screw spike inserted in the fastening hole 52*b*.

The hinge hole 52*c* formed in the inward middle portion of the engaging piece 52 is a hole for hinge-engaging the engaging piece 52 and the connector 53. The engaging piece 52 and the connector 53 are hinge-engaged by inserting a fixing means such as a fixing pin. Accordingly, the slider 10 slides by the connector 53 when the upper connecting pole 50 is rotated.

The contact protrusion 52*d* formed at the inward lower portion of the engaging piece 52 comes into contact with the connector 53 when the upper connecting pole 50 is folded so as to restrict the rotation of the upper connecting pole 50 to a predetermined range.

Figure 2:
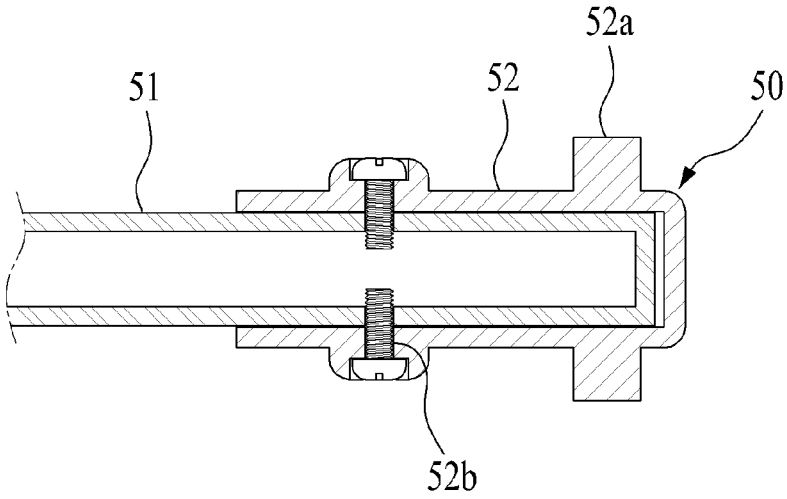
FIG. 2 is a cross sectional view showing the engaged state of an upper connecting pole of the cabin tent frame according some embodiments of the present invention.

Especially, as shown in FIG. 2, the upper portion of the connecting bar 51 inserted into the inserting hole of the engaging piece 52 is inserted down to the position of the engaging protrusion 52*a*. Thereby, during the relative rotation between the housing 20 and the engaging piece 52, the bearing capacity of the engaging piece 52 is improved.

The cover 40, which is a cover member coupled to the upper portion of the housing 20, covers the upper side of the engaging slot 22*b* to prevent the breakaway of the engaging piece 52 that is hinge-engaged to the housing 20. This cover 40 includes a lid portion 41, a plurality of protrusion pieces 42 and a plurality of inserting protrusions 43.

The lid portion 41 is formed at the center of the cover 40 to cover the upper side of the through hole 21 of the housing 20. The plurality of protrusion pieces 42 are formed radially in protrusion around the outer circumference of the lid portion 41. In the protrusion pieces 42 are formed fastening holes 42*a* communicating with the fixing holes 22*a* of the housing 20. Fastening and fixing means such as a screw spike is inserted in the fastening holes 42*a* to engage and fix the cover 40 to the housing 20.

In addition, at the lower portion of each protrusion piece 42 is formed the inserting protrusion 43 downward in protrusion. The inserting protrusion 43 is inserted into the engaging slot 22*b* to close the upper side of the engaging slot 22*b*, so that the breakaway of the engaging piece 52 is prevented.

The connector 53 whose one end is formed in a branched bar shape is a link member for connecting the upper connecting pole 50 and the slider 10. In the hinge slot formed at one branched end are formed first connecting holes 53*a* respectively and at the other end is formed a second connecting hole 53*b*.

The first connecting holes 53*a* are formed so as to communicate with the hinge holes 52*c* of the upper connecting pole 50. Accordingly, by fastening a fastening means such as a bolt to the hinge holes 52*c* and the first connecting holes 53*a*, with the engaging piece 52 inserted into the hinge slot formed at one end of the connector 53, the connector 53 is pivotally engaged with the upper connecting pole 50.

The second connecting hole 53*b* is formed so as to communicate with the hinge holes 12*a* of the slider 10. Accordingly, by fastening a fastening means such as a bolt to the hinge holes 12*a* and the second connecting hole 53*b*, with the other end of the connector 53 inserted into the engaging slots 12 of the slider 10, the connector 53 is pivotally engaged to the slider 10.

Accordingly, when the upper connecting pole 50 is folded or unfolded, the slider 10 is link-engaged by the connector 53 to be slid up and down along the outer surface of the housing 20.

In folding the upper connecting poles 50, it is preferable that the inward angle $\alpha$ between the engaging piece 52 and the connector 53 is formed at 130° to 180°. The reason for that is because if the inward angle $\alpha$ is less than 130° the upper connecting pole 50 is expanded outward when the upper connecting pole 50 is folded, so the volume becomes large to make it inconvenient to move and carry it and the unfolding operation is not smooth. On the other hand, if the inward angle $\alpha$ is more than 180° a reaction force acts against folding between the engaging piece 52 and the connector 53 when the unfolded state of the upper connecting pole 50 is switched to the folded state. Therefore, additional operation is needed to remove the reaction force, so not only the folding operation is cumbersome but also the upper connecting poles 50 intersect to make an in-between space small and accommodation of tent cloth difficult.

Especially in order to further facilitate the folding of the upper connecting poles 50, it is more preferable that the inward angle $\alpha$ between the engaging piece 52 and the connector 53 be formed at 170° to 180° to make folding possible even with a very small operation force.

When the upper connecting poles 50 are unfolded, the engaging piece 52 of the upper connecting pole 50 is rotated with the connecting bar 51 completely inserted therein. Therefore, the rotational bearing capacity between the engaging piece 52 and the housing 20 during unfolding is improved, so that damage to the engaging piece 52 can be prevented.

Figure 3:
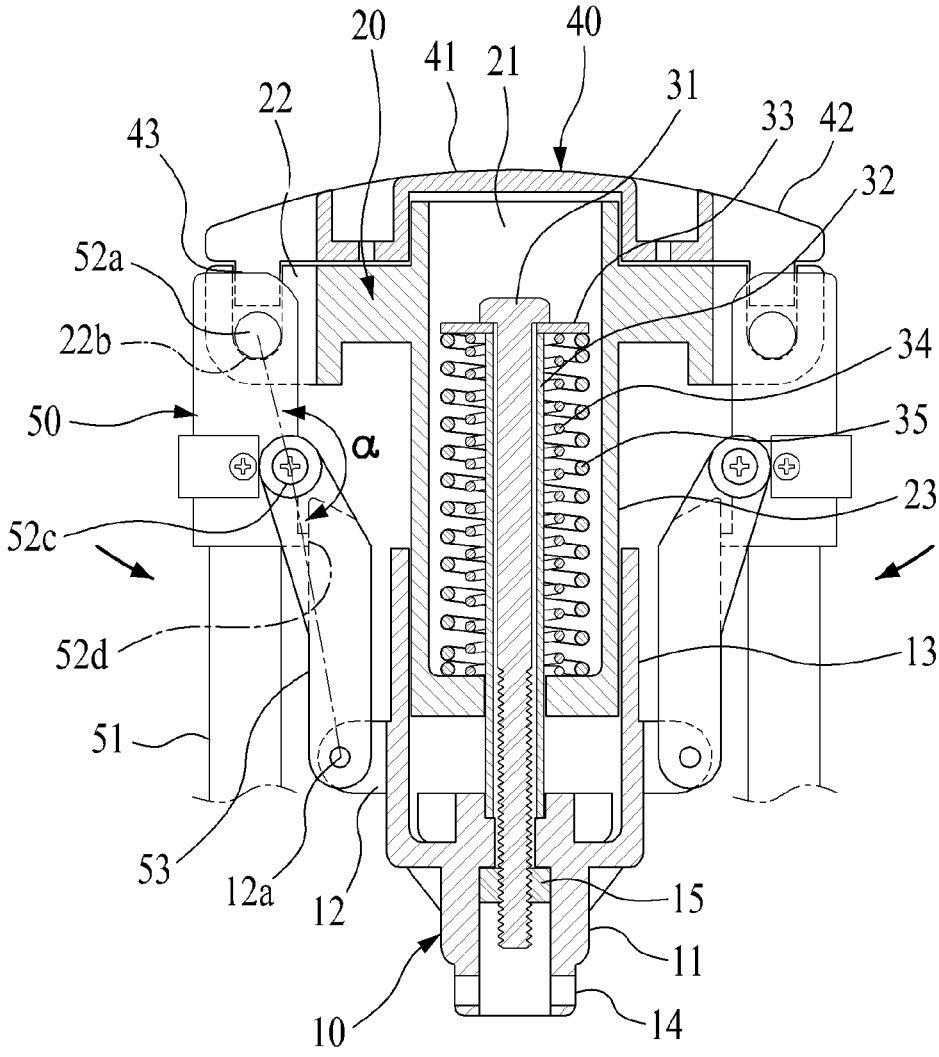
FIG. 3 is a cross sectional view showing the folded state of the cabin tent frame according to some embodiments of the present invention.

Below with reference to FIGS. 3 and 4, the folding and unfolding operation of the cabin tent frame of the present embodiment will be specifically described.

In a state that the upper connecting pole 50 is folded as shown in FIG. 2, the user unfolds the upper connecting pole 50 by pivoting it in the outer direction to unfold the cabin tent. Then, the upper connecting poles 50 are pivoted on the engaging protrusions 52*a* of the engaging piece 52 that are hinge-engaged to the housing 20 as shown in FIG. 3.

Figure 4:
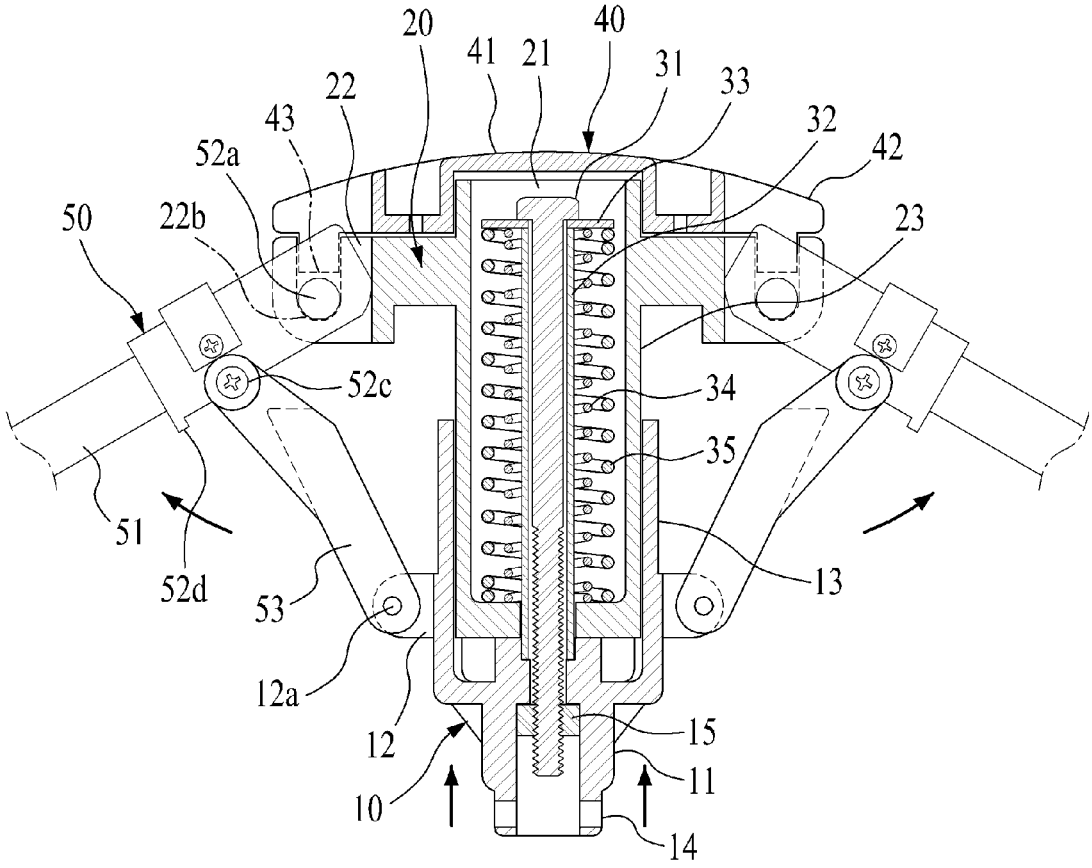
FIG. 4 is a cross sectional view showing the unfolded state of the cabin tent frame according to some embodiments of the present invention.

Thus, when an upward force of operation is transmitted to the connector 53 hinge-engaged to the middle of the engaging piece 52, the upward force of operation is transmitted also to the slider 10 hinge-engaged to the connector 53, so that the slider 10 is moved upward as shown in FIG. 4. At this time, the fixing unit 30 is elastically supported at the upper side of the slider 10 through the stepped portion of the housing 20, so the upward movement of the slider 10 is made smoothly without any difficulties through the elastic force of the first and second springs 34 and 35.

And, the upper end of the connecting bar 51 is inserted into the inserting hole formed in the engaging piece 52 as far as the position of the engaging protrusion 52*a* so as to rotate together with the engaging piece 52. Since the connecting bar 51 is rotated with it inserted completely into the inside of the engaging piece 52, the bearing capacity is improved during the rotation of the engaging piece 52 to prevent damage to the engaging piece 52.

To fold the upper connecting pole 50, reverse the operation mentioned above. That is, if the user applies pressure to the upper connecting pole 50 from an outer side to inner side, the connector 53 engaged thereto is moved downward, so that the slider 10 is moved downward from the housing 20 against the spring force of the first and second springs 34 and 35 to return it to the original position as shown in FIG. 3.

As described above, according to the present invention, by forming an engaging slot in the housing, providing the upper connecting pole with an engaging piece in which an engaging protrusion is hinge-engaged, and inserting a connecting bar into the engaging piece, the rotational bearing capacity of the engaging piece is improved during the rotation of the upper connecting pole as well as providing an effect of preventing damage to the engaging piece.

In addition, by forming in the engaging piece a contact protrusion that comes into contact with the connector when folding the upper connecting pole, the rotation of the upper connecting pole is restricted to a predetermined range as well as safety accidents can be prevented by blocking hand-jamming when folding the upper connecting pole.

While the present invention has been shown and described in connection with an exemplary embodiment together with the accompanying drawing, it will be apparent to those skilled in the art that the above exemplary embodiment is proposed only for illustration purpose, and modifications and variations and other equivalent embodiments can be made therefrom. Accordingly, essential technical configurations of the present invention to be protected should be defined without departing from the spirit and scope of the invention as defined by the appended claims.

What is claimed is:

1. A cabin tent frame comprising:

a housing having an insertion portion with a through hole formed in a longitudinal direction of the housing, a plurality of inserting slots formed at substantially equal intervals on an outer circumference of an upper elongated portion which is outwardly elongated from the insertion portion of the housing, and engaging slots formed on both side walls of at least one of the plurality of inserting slots;

a slider slidably coupled with the housing in such a manner that the insertion portion of the housing is inserted inside the slider;

a fixing unit inserted into the through hole of the housing to be fixed and installed in the slider, and elastically supported through at least one elastic member installed in the through hole of the housing;

an upper connecting pole having an engaging piece in which engaging protrusions are formed in protrusion on both sides of an upper portion of the engaging piece so as to be inserted into the engaging slots of the housing for hinge-engaging therewith, and a connecting bar to which the engaging piece is installed at an upper end thereof;

a cover which covers an upper portion of the engaging slots to prevent the breakaway of the engaging piece and is coupled to an upper portion of the housing; and a connector, one end of which is hingedly coupled to the upper connecting pole and the other end of which is hingedly coupled to the slider, wherein the connecting bar of the upper connecting pole is inserted into an inserting hole formed in the engaging piece, and one end of the connecting bar is inserted into the inserting hole as far as the position of the engaging protrusions formed at the engaging piece, and wherein the engaging piece further includes a contact protrusion formed at the inward lower portion thereof, so that the engaging piece comes into contact with the connector during the folding of the upper connecting pole so as to restrict the rotation of the upper connecting pole.

* * * * *